US008062055B2

(12) United States Patent
Myer et al.

(10) Patent No.: US 8,062,055 B2
(45) Date of Patent: Nov. 22, 2011

(54) MULTI-POSITION CONNECTOR

(75) Inventors: John Mark Myer, Millersville, PA (US); John Wesley Hall, Harrisburg, PA (US); Hurley Chester Moll, Hershey, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/797,448

(22) Filed: Jun. 9, 2010

(65) Prior Publication Data

US 2010/0317219 A1 Dec. 16, 2010

Related U.S. Application Data

(60) Provisional application No. 61/186,250, filed on Jun. 11, 2009.

(51) Int. Cl.
*H01R 13/62* (2006.01)

(52) U.S. Cl. ..... 439/366

(58) Field of Classification Search ..... 439/366, 439/876, 78–79, 852–853, 857, 682, 947
See application file for complete search history.

(56) References Cited

U.S. PATENT DOCUMENTS

| | | | | |
|---|---|---|---|---|
| 4,803,043 | A * | 2/1989 | DeMario et al. | 376/442 |
| 5,209,899 | A * | 5/1993 | Johansson et al. | 376/442 |
| 6,210,240 | B1 | 4/2001 | Comerci et al. | |
| 6,749,463 | B1 | 6/2004 | Fan | |
| 7,044,812 | B2 | 5/2006 | Fry, Jr. et al. | |
| 7,086,913 | B2 | 8/2006 | Myer et al. | |
| 2006/0227925 | A1 * | 10/2006 | Marzean | 376/438 |

FOREIGN PATENT DOCUMENTS

| | | |
|---|---|---|
| DE | 1 276 158 | 8/1968 |
| EP | 0 407 079 | 1/1991 |
| WO | WO 2007/016794 | 2/2007 |

OTHER PUBLICATIONS

International Search Report, International Application No. PCT/US2010/001680, International Filing Date Nov. 6, 2010.

* cited by examiner

*Primary Examiner* — Jean Duverne

(57) ABSTRACT

A connector assembly includes a housing that includes one or more slots for inserting a component defined in a top side of the connector housing. Each slot includes a first and a second interior surface separated by a distance. Channels are defined in each surface and are adapted to receive a portion of a terminal. Openings for receiving a terminal are defined in a bottom surface of the housing. When the terminal is fully inserted into the opening the terminal portion is substantially adjacent to a surface within the channel and a contact region of the terminal is substantially centered between the first and second interior surfaces of the slot so as to enable lateral movement of the contact portion between the first and second surfaces when the component is inserted.

20 Claims, 9 Drawing Sheets

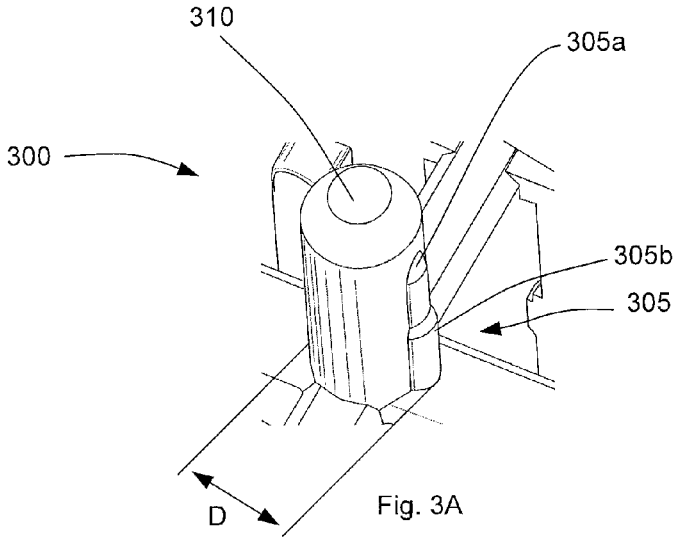
Fig. 3A
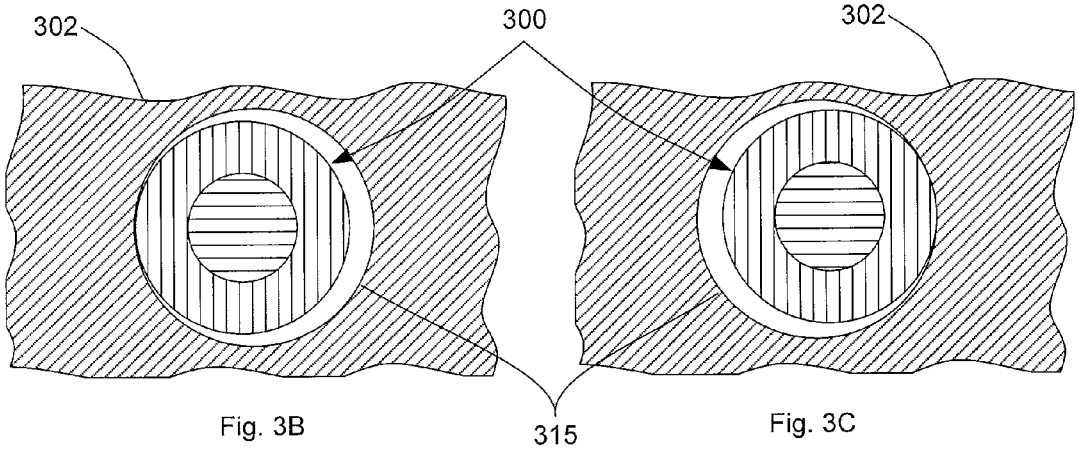
Fig. 3B
Fig. 3C
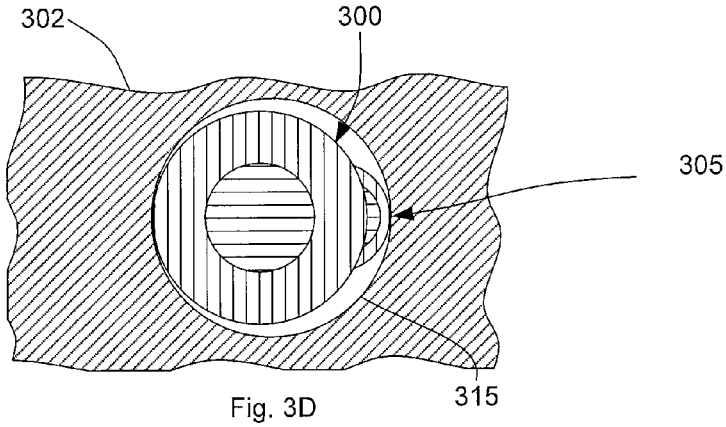
Fig. 3D

MULTI-POSITION CONNECTOR

RELATED APPLICATIONS

This application claims the benefit of the filing date under 35 U.S.C. §119(e) of U.S. Provisional Application Ser. No. 61/186,250, filed Jun. 11, 2009, the contents of which are hereby incorporated by reference in their entirety.

BACKGROUND

I. Field

The present invention relates generally to electrical connectors. More specifically, the present invention relates to a multi-position connector used with a fuel cell.

II. Discussion

As the cost of energy has soared so to has the pace of research into alternative sources of fuels. Most people experience the high cost of fuel at the fuel pump. For example, in recent years the price of petroleum has doubled and even tripled in some places.

To combat the high cost of fuels, automotive manufacturers have begun developing vehicles utilizing various combinations of technology to improve fuel efficiency. For example, many automotive manufacturers produce hybrid vehicles. These vehicles achieve higher average fuel efficiency by utilizing a combination of electricity and gas to power the vehicle. Other vehicles are being adapted to run solely on electricity. These vehicles typically utilize an array of expensive batteries that provide power to an electric motor.

Another technology being explored is the use of fuel cells. Fuel cells derive their name from the fact that they produce electricity like a battery cell. Unlike batteries, however, fuel cells derive their energy from a fuel, such as hydrogen. Once the energy of the fuel cell is depleted, hydrogen may be added to the fuel cell to "recharge" the fuel cell.

Typically, it is necessary to use stacks of fuel cells, or fuel cell plates stacked together, to produce the amount of energy needed for a vehicle. In fuel cells, an electrical connection is required for each fuel cell plate. However, one problem with fuel cells is that they often exhibit a relatively high variability in the distance between the plates. Consequently, current fuel cell stacks require individual connectors for each plate. This prevents the use of a multi-position type of connector resulting in a more complicated and more costly electrical connection to the fuel cell.

SUMMARY

In one aspect, a connector assembly includes a housing, which contains one or more slots for inserting a component, such as a fuel cell. The slots are defined in a top side of the housing. Each slot may include a first and a second interior surface. The surfaces may be separated by a distance that is greater than a thickness of the plates of an inserted component. Channels may be defined in each surface. The channels may be adapted to receive a first section of a terminal.

An opening may be defined in a bottom portion of the housing for receiving one or more terminals. When the terminals are fully inserted into the openings, the first section of each terminal may be disposed substantially adjacent to surfaces within the channels. A contact region of the terminal may be substantially centered between the first and second interior surfaces of the slot. This may enable the contact region to move laterally between the first and second surfaces when the component is inserted. This lateral movement compensates for misaligned components, such as plates of a fuel cell.

In another aspect, a connector terminal includes a plurality of straps that define a first section, curved section, and second section. In the first section, the plurality of straps are separated by a distance and the straps extend substantially parallel to one another.

In the second region, the plurality of straps define a contact region and the straps may be joined at a contact end of the terminal.

In yet another aspect, a connector housing includes a slot defined in a top portion, and a terminal positioned within the slot. An opening may be defined in a bottom portion of the housing for receiving a lock member.

The lock member may be adapted to be inserted into the opening of the housing. The position of the lock member within the opening may define an open and closed state. When the lock member is in the open state, a component, such as a fuel cell, is insertable into the slots defined in the top side of the housing. When the lock member is in a locked state, an inserted component cannot be removed from the slots of the housing under normal usage. When the component is partially inserted into the slot, the lock member is prevented from entering the locked state.

BRIEF DESCRIPTION OF THE DRAWINGS

The accompanying drawings are included to provide a further understanding of the claims. The drawings are incorporated in and constitute a part of this specification and illustrate exemplary embodiments that fall within the scope of the claims.

FIG. 3A is a magnified view of an alignment pin;

FIGS. 3B and 3C illustrate an alignment pin inserted into an opening of a circuit board;

FIG. 3D illustrates an alignment pin with a crush rib inserted into an opening of a circuit board;

DETAILED DESCRIPTION

The embodiments below describe a connector assembly that provides a secure electrical connection to a component that exhibits a high degree of variability in the spacing between plates of the component. For example, in an embodiment as described herein, the connector assembly may provide a secure electrical connection to a fuel cell that includes a group of fuel cell plates stacked together, as described above. The distance between the plates may be highly variable. Terminals of the connector assembly are adapted to allow for lateral movement of a contact region of the terminal in slots of a housing of the connector assembly into which the plates are inserted. The widths of the slots may be larger towards ends of the housing and smaller towards the center of the housing to evenly distribute any tolerance build-up between the respective distances of the plates. A lock member may be provided to ensure that the component is properly inserted into the connector.

Figure 1A:
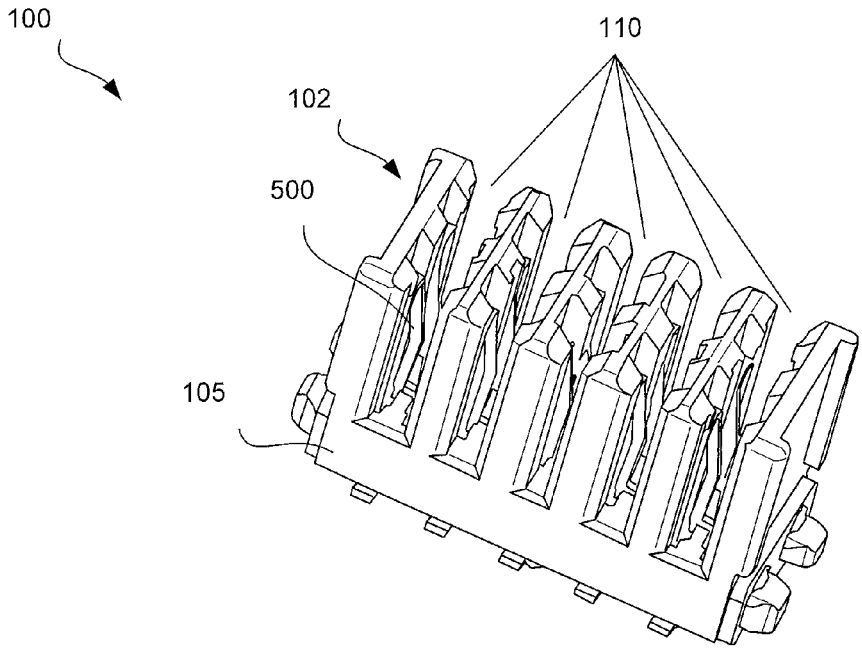
FIG. 1A is a top perspective view of a connector assembly for coupling a component to a printed circuit board; this is actually the header (connector) that connects all (or at least a group) of components (plates) to the PCB. John, is this limited to only connecting to a PCB? Could we used this header design to connect to a contact connector?
Figure 1B:
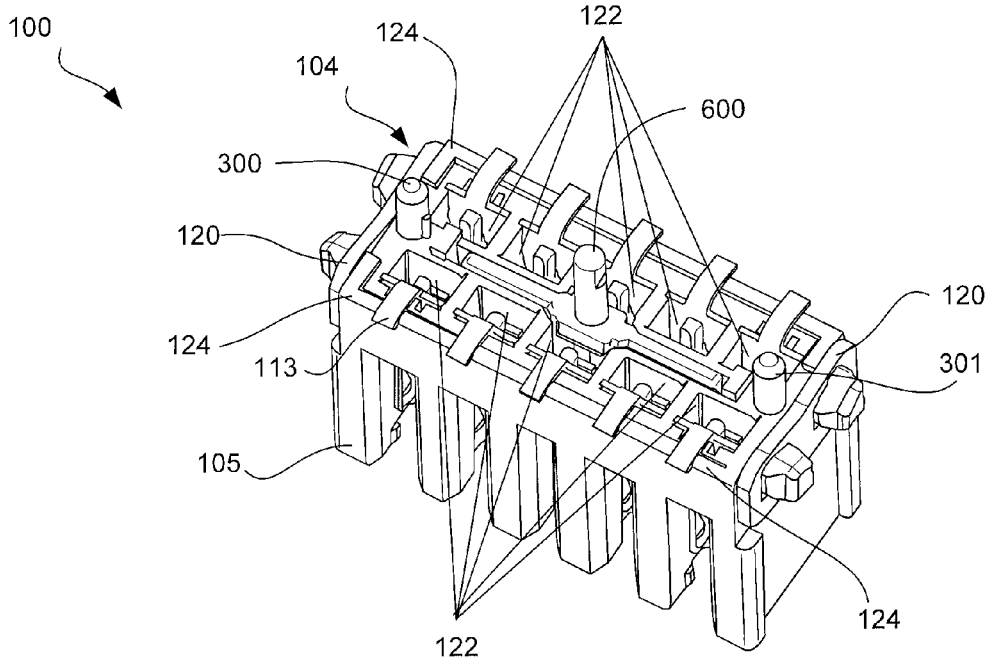
FIG. 1B is a bottom perspective view of the connector assembly of FIG. 1A.
Figure 2:
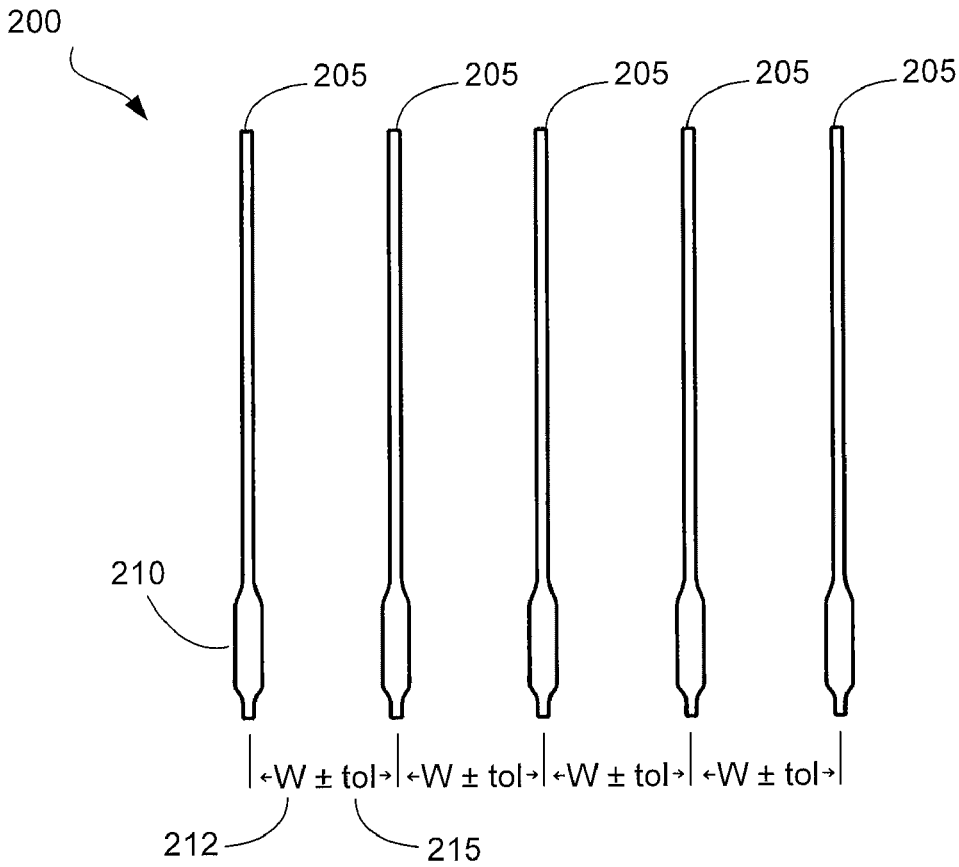
FIG. 2 is a side view of an exemplary component that may be inserted into the connector assembly of FIG. 1A.

FIGS. 1A and 1B are top and bottom perspective views, respectively, of a connector assembly 100 for coupling a component to a printed circuit board. FIG. 2 is a side view of an exemplary component that may be inserted into the connector of FIG. 1A.

As shown in FIG. 2, the component 200 may include plates 205. Each plate 205 may include a tab 210 at an end. The tab 210 is an electrical contact adapted to carry electrical energy from the plate to a terminal on a connector, such as the connector assembly 100 of FIG. 1. The thickness of each tab 210 may be larger than the thickness of a respective plate. Each plate 205 may be separated by a distance equal to a nominal distance W 212 plus or minus a tolerance value tol 215. For example, the nominal distance W 212 between the plates may be 5 mm and the tolerance value 215 may be 1 mm. In the example shown in FIG. 2 with 5 plates, the distance between the outside most plate and the center plate may be anywhere from 8 mm to 12 mm.

Referring back to FIGS. 1A and 1B, in an exemplary embodiment the connector assembly 100 includes a housing 105, a plurality of terminals 500, and a lock member 600. The housing 105 includes a group of slots 110 defined in a top side 102. Each individual slot 110 may be adapted to receive a portion of an individual plate of a component, such as a tab 210 on the plate 205 shown in FIG. 2. Disposed within the slots 110 are terminals 500. The terminals 500 are configured to make electrical contact with tabs on the component plates. In some embodiments, there may be two terminals disposed within each slot. However, the slots may be configured to accept more than two terminals, 1 terminal, or no terminals.

As shown in FIG. 1B, the bottom surface 104 of the housing 105 includes solder clips 120 on either side of the housing 105. The solder clips 120 enable soldering the connector assembly 100 to a printed circuit board via or a solder pad (not shown) by way of, for example, a reflow process. Also shown are a pair of alignment ribs 124 that run along peripheral edges of the bottom surface 104. One form of the solder clips 120 and alignment ribs 124 are described in more detail in U.S. Pat. Nos. 7,086,872, 7,086913, and 7,044812, which are hereby incorporated by reference in their entirety.

Several openings 122 are defined in the bottom surface 104 of the housing 105 for receiving terminals. Solder tails 113 of the terminals are shown extending out of the openings 122.

A lock opening (not shown) may be defined in the bottom surface 104 of the connector assembly 100 for receiving a lock member 600. The lock member 600 may be utilized to secure a component into the connector assembly 100. The lock member 600 is described in more detail below.

A first alignment pin 300 and a second alignment pin 301 may extend from the bottom surface 104 of the housing 105, as shown. In some embodiments, a crush rib may extend from one of the alignment pins 300 and 301, as shown in FIG. 3A.

FIG. 3A is a magnified view of an alignment pin 300 with a crush rib 305. The alignment pin 300 may correspond to the first alignment pin 300 shown in FIG. 1B. As shown in FIG. 3A, a tip 310 of the alignment pin 300 may be tapered to allow for easy alignment and insertion of the connector assembly onto a printed circuit board. The crush rib 305 may be disposed on an outer surface of the alignment pin 300. The crush rib 305 may be positioned so that it is inline with the longitudinal axis of the housing. That is, the axis that runs through all the slots of the housing. The top end 305*a* of the crush rib 300 may be tapered to allow for easy insertion of the alignment pin 300. The thickness of the crush rib 305 may gradually increase in thickness towards a middle portion 305*b* of the crush rib 305. The thickness measured from the outer surface of the crush rib 305 at the middle portion 305*b* to a side of the alignment pin 300 opposite the crush rib 305, D, may be sized so that the alignment pin 300 is compressed when inserted into an opening in a circuit board that receives the alignment pin 300.

In operation, when placing the connector assembly on a circuit board 302, alignment pins 300 of the housing may enter into complementary openings 315 of the circuit board 302, as shown in FIGS. 3B and 3C. In general, however, the diameter of the openings 315 may be slightly larger than the diameter of the alignment pins 300. This may result in less accurate positioning of the connector, because the position of the alignment pin 300 may fluctuate within the opening 315 in the circuit board 302. For example, the alignment pin 300 may rest against the left side of the opening 315, as shown in FIG. 3B, or the right side of the opening 315, as shown in FIG. 3C. This results in variability in the position of the connector assembly, which may present a problem when used with a component, such as the component of FIG. 2. As noted above the distance between plates in a component may vary. Because the openings in the circuit board 304 have larger diameters than the diameter of the alignment pins 300 pins, additional variability may be introduced.

However, as shown in FIG. 3D, when a crush rib 305 is included on one of the alignment pins 300, that alignment pin 300 is pushed up against the side of the opening 315 opposite the crush rib 305, as shown. In other words, the crush rib 305 aligns the alignment pin 300 in the opening 315 in a consistent manner. This in turn improves the positioning accuracy of the connector, which may be important given the tolerance issues associated with components that may be inserted into the connector. To accommodate openings that are slightly different in size, the crush rib 305 may be made small enough or out of a flexible material so that when inserted it deforms.

Figure 4A:
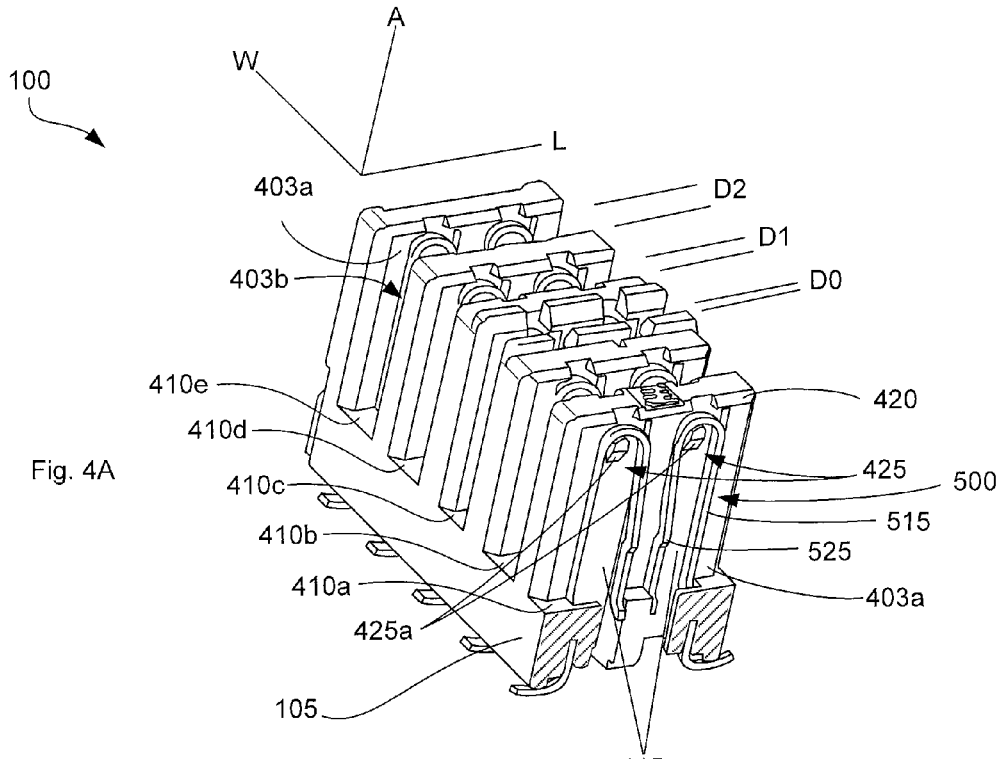
FIGS. 4A and 4B are cross-sectional views illustrating interior details of slots of a housing of a connector assembly.
Figure 4B:
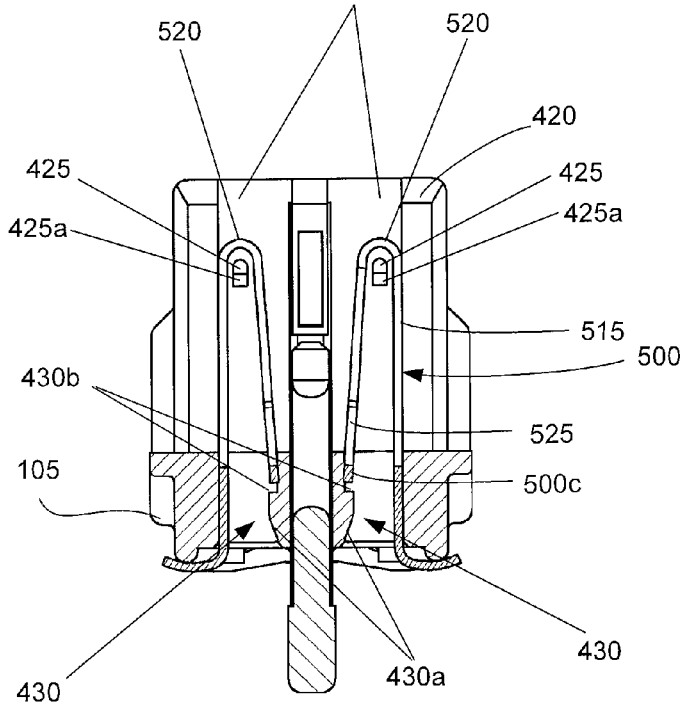
Figures 4C, 4D, 4E:
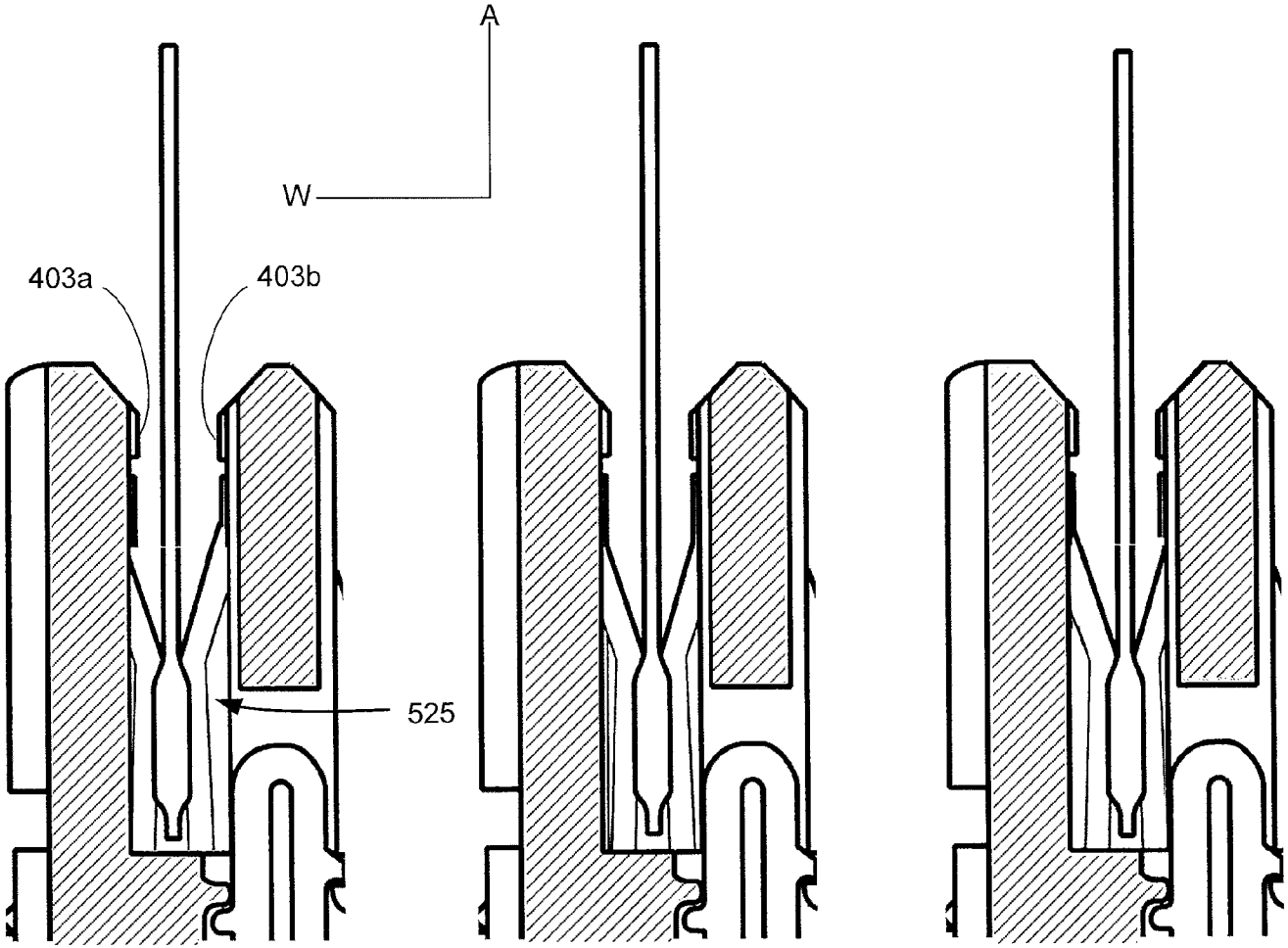
FIGS. 4C, 4D, and 4E illustrate a component plate positioned towards the left, middle, and right of a slot, respectively.

FIGS. 4A and 4B are cross-sectional views of a connector housing 105 showing interior details of slots 410*a-e*. As shown, in FIG. 4A, each slot 410*a-e* includes a first interior surface 403*a* and second interior surface 403*b* facing the first interior surface 403*a*. Each slot 410*a-e* has a length in the "L" axis direction, a depth in the "A" axis direction, and a width in the "W" axis direction. A component plate, such as a fuel cell plate, is inserted in the "A" axis direction so that the component plate sits within the slot along the "L" axis The slot width is the distance (D0, D1, D2, etc) between the first interior surface 403*a* and the second interior surface 403*b* of each slot 410*a-e* and may vary based on the relative location of the slot within the group of slots. For example, the width D1 of a first slot 410*d* may be greater than the width D0 of the middle slot 410*c*. The width D2 of a second slot 410*e* may be greater than the width of the first slot 410*d*. The width of the middle slot 410*c* may be the smallest of all of the slots. The slots on the other side of the middle slot 410*c* may have widths that mirror those of the first and second slots 410*d-e*. This enables even distribution of the tolerance build-up exhibited by component plates, such as those described in FIG. 2 above. For example, referring to FIG. 2, the nominal distance between the center plate and the plate on the immediate left or right of the center plate may be W. The nominal distance between the center plate and the left or right most plate may equal 2 W. However, when tolerances are considered, the distance between the center plate and the plate to the immediate left or right of the center plate may vary by ±2 Tol. The distance between the center plate and the right or left most plate may vary anywhere between ±3 Tol. In other words, the variability of a given plate depends on how far it is from the center plate. To accommodate for this variation, the width of the respective slots may be sized to accommodate this variation in the plate spacing. As will be further described below, the terminals are mounted in each slot to provide the electrical contact for each plate when the connector is mounted to the component Two terminals 500, described below, may be mounted in each slot 410*d-e*. One or more channels 415 may be defined in each surface 403*a* and 403*b* of each slot 410*a-e* and may extend in the "A" axis direction, as shown in FIGS. 4A and 4B. Each channel 415 is configured to receive a first section 515 of a terminal 500. A second section 525, of the terminal may be positioned so that it is substantially centered between the first and second surfaces 403*a* and 403*b* that define the slots 410*a-e*. The second section 525 is configured to laterally move between the first and second surfaces 403*a* and 403*b*, along the "W" axis, when the component is inserted, as shown in FIGS. 4C, 4D, and 4E, which show the second section 525 positioned towards the left, center, and right of a slot, respectively. This movement enables the insertion of components that exhibit variability in the distance between plates, such as the component of FIG. 2.

A guide 420 may be provided on a top edge of each surface 403*a* and 403*b*. The guide 420 may enable sliding a component into the connector assembly 100. The guide 420 may be adapted to protect the first section 515 of the terminal from damage when the component is inserted into the slot 410*a-e*. The profile of the guide 420 may correspond to a chamfer or radius or other profile.

Retention bumps 425 may be provided near the top of each channel 415, as shown in FIGS. 4A and 4B. Curved sections 520 of terminals 500 in the housing may be located just above the retention bumps 425. A ramp 425*a*, such as a chamfer or radius, may be provided on a lower face of the retention bump 425. The ramp 425*a* may enable slidably inserting and securing the terminal 500 within the housing 105. For example, during terminal 500 insertion, the ramp 425*a* may allow the curved section 520 of the terminal 500 to slide up and over the retention bump 425. The top surface of the retention bump 425 may be shaped to prevent the curved section 520 of the terminal 500 from sliding down passed the retention bump 425. The retention bump 425 may help prevent deformation or kinking of the terminal 500 during component insertion, because it is positioned below the curved section 520 of the terminal 500.

As shown in FIG. 4B, retaining surfaces 430 may be provided in an opening, as shown. The contact ends 500*c* of terminals 500 in the housing may be located just above the retaining surfaces 430. The retaining surfaces 430 may include a tapered region 430*a* and a flat region 430*b*. The profile of the tapered region 430*a* may be a chamfer, radius, or other profile. The tapered region 430*a* may enable a contact end 500*c* of a terminal to ride up over the retaining surface 430 and onto the flat region 430*b*, which may further secure the terminal 500 in the opening defined in the bottom of the housing 105.

Figure 5A:
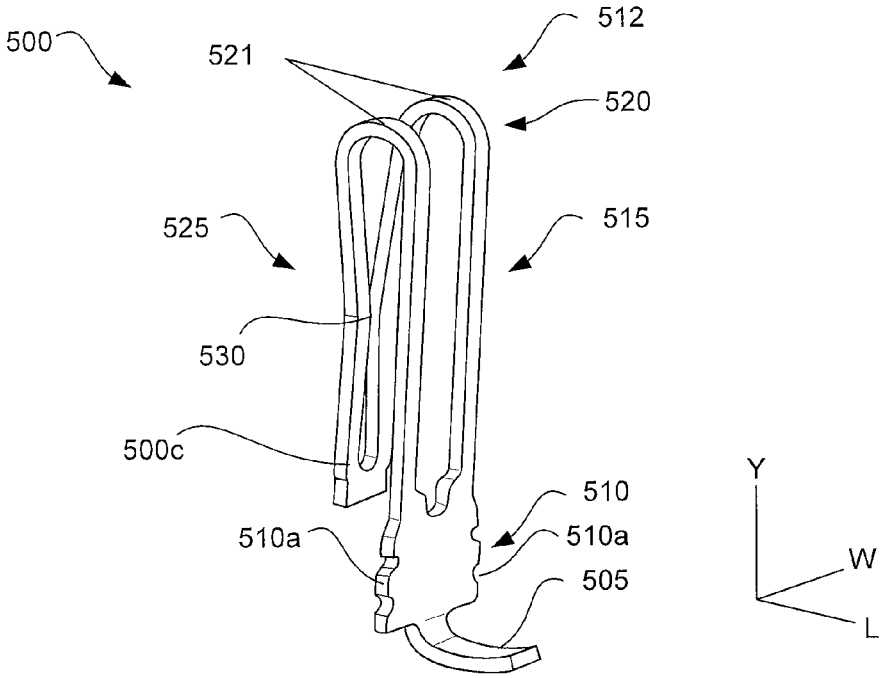
FIG. 5A is a perspective view of a terminal that may be utilized in connection with the connector assembly of FIG. 1.
Figure 5B:
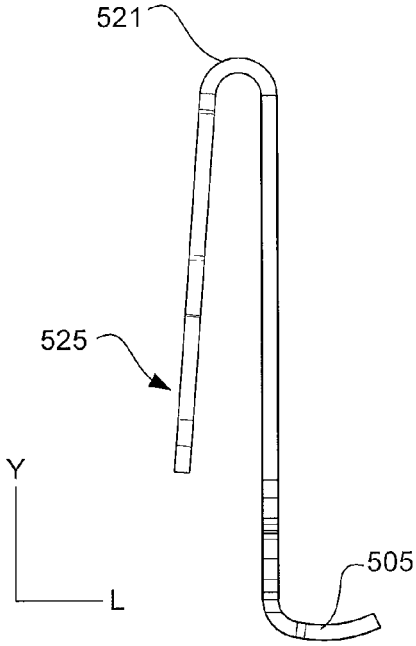
FIG. 5B is a side view of the terminal shown in FIG. 5A.
Figure 5C:
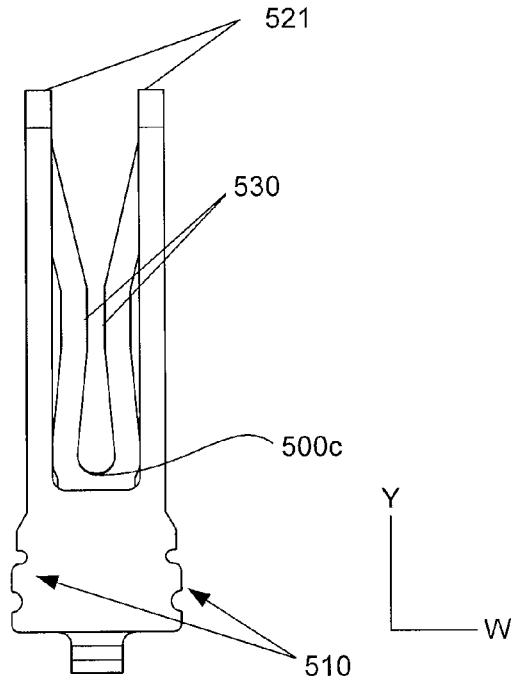
FIG. 5C is a front view of the terminal shown in FIG. 5A.

FIGS. 5A, 5B, and 5C are perspective, side, and front views, respectively, of the terminal 500 that may be utilized in connection with the connector assembly 100 of FIG. 1A. The terminal 500 includes a main body 512, a retention portion 510, and a solder tail 505.

The solder tail 505 may be soldered to a printed circuit board to enable electrical communication with the printed circuit board. Retention portion 510 may be defined at a first end of the terminal 500. The retention portion 510 is utilized to secure the terminal 500 in the opening 122 (FIG. 1) of the bottom surface 104 of a connector housing 105 (FIG. 1). The retention portion 510 may include grooved surfaces 510*a*.

The main body 512 includes a plurality of straps 521 extending from the retention section 510 to the contact end 500*c* that define a first section 515, a curved section 520, and a second section 525. The first section 515, curved section 520, and second section 525 may generally define a U-shape or other shape. The first section 515 extends from the retention portion 510. In the first section 515, the straps 521 may be separated in the W direction by a distance that generally equals the distance the width of the slots 410*a-e* defined by the first and second interior surfaces 403*a* and 403*b* of a slot 410*a-e*. The straps 521 may be substantially parallel to one another. The first section 515 and the second section 525 are separated in the L direction by a distance generally equal to the length of the channel 415.

In the second section 525, the straps 521 angle in towards one another to define a contact region 530, as shown. In the contact region 530, the distance between the straps 521 may narrow so that the contact region 530 provides a secure electrical connection with a tab of a component inserted into the connector. For example, the distance between the straps 521 at the contact region 530 may be smaller than the width of a tab 210 of the component 200 of FIG. 2. By virtue of the geometry of the contact region 530, an elastic force may be applied against the tab by the straps 521 at the contact region 530. The straps 521 are joined at the contact end 500*c* at the end of the second section 525 opposite the curved section 520.

The combination of the slot width and terminal 500 geometry enables lateral movement of the second section 525 between first and second interior surfaces (403*a* and 403*b*, FIG. 4*a*) of a slot 410*a-e* (FIG. 4). In other words, the contact region 530 of the second section 525 of each strap may be able to move in the region between the first and second interior surfaces 403*a* and 403*b* when a component plate is inserted and still provide a secure electrical connection with the component plate. This movement enables the insertion of components that exhibit variability in the distance between component plates, such as fuel cell plates. For example, as described above, the distance between an outside plate and a center plate of a component may be anywhere from 8 mm to 12 mm. The second section 525 of the terminal 500 may be capable of laterally moving within the slots to compensate for this variation and provide a secure connection to the component.

Figure 6:
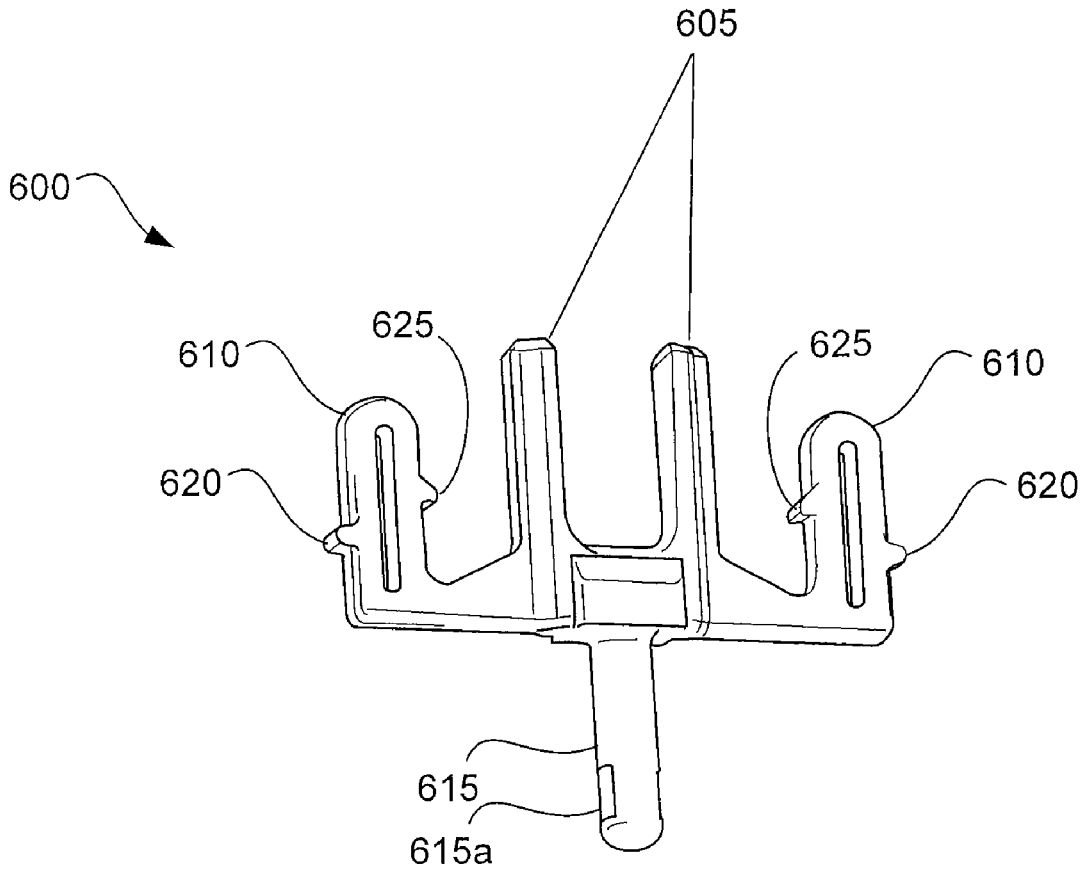
FIG. 6 is a perspective view of a locking member, which may be utilized in connection with the connector assembly of FIG. 1.
Figures 7A, 7B:
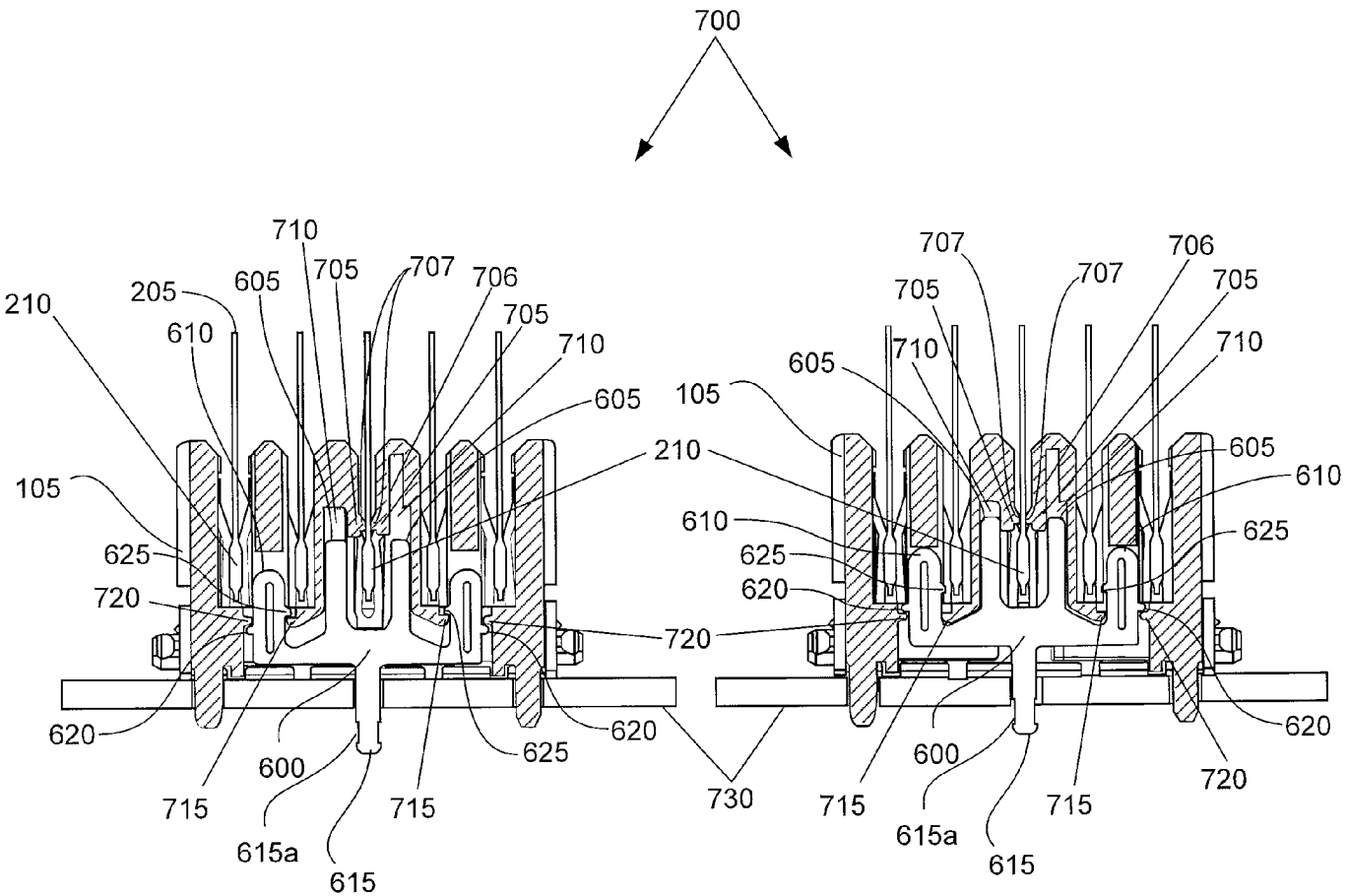
FIG. 7A is a cross-sectional view of an interior region of a housing showing an inserted lock member in an open state.
FIG. 7B is a cross-sectional view of an interior region of a housing showing an inserted lock member in a locked state.

FIG. 6 is a perspective view of a lock member 600, which may be utilized in connection with the connector assembly 100 of FIG. 1. The lock member 600 is adapted to be inserted into the opening of a connector housing 105, such as the opening described above in FIG. 1B in the bottom surface 104 of the connector housing 105. The lock member 600 includes a pair of inner fingers 605, a pair of outer fingers 610, and an inspection pin 615. Included on the pair of outer fingers 610 are a first and a second pair of retention bumps 625 and 620. The inspection pin 615 extends from a bottom surface of the lock member 600 and is adapted to extend through an opening in a circuit board, as shown in FIGS. 7A and 7B. The inspection pin 615 may also include a mark or an indentation 615*a* that enables visually determining whether the lock member 600 is in a locked or an unlocked state.

FIGS. 7A and 7B are cross-sectional views of an interior region 700 of a housing 105 showing an inserted lock member 600 in an open state and a closed state, respectively.

Referring to FIG. 7A, the first interior surface 403*a* and the second interior surface 403*b* of at least one slot 410*a-e* includes at least one flexible latch 705. The flexible latch 705 comprises a flexible arm 706 and a protrusion 707 extending from the flexible arm 706 into the slot 410*a-e* from the first interior surface 403*a* and the second interior surface 403*b*. In the exemplary embodiment, the protrusions 707 are located generally opposite one another. The distance between the protrusions may be greater than a thickness of a component plate 205, but less than a thickness of a tab 210 on the component plate 205. A channel 710 id formed in the housing 105 adjacent each flexible arm 706.

In a pre-locked state, the lock member is inserted in the opening in the housing and held in a pre-locked position. The inner fingers 605 (FIG. 6) on the lock member 600 are disposed in channels 710 below the latches 705 so that the channels 710 adjacent to the flexible arms are free to move. This allows for movement of the latches 705 during component insertion. For example, when a component is inserted, the latches 705 are allowed to move into the channels 710 behind the latches 705 when a tab 210 of the component plate 205 passes through the space between the latches 705.

In the pre-locked state, the locking member is inserted so that the first pair of retention bumps 625 (FIG. 6) on the lock member 600 may rest on the first pair of retention surfaces 715 in the housing 105, as shown. This may prevent the lock member 600 from falling out of the housing 105 when the connector assembly (100 FIG. 1) is handled. The retention bumps 625 also prevent the lock member 600 from falling out of the housing 105 during shipping or until the connector assembly 100 is placed on the printed circuit board.

Latches 705 also prevent the insertion of the locking member 600 if the component is not fully loaded or partially inserted into the housing 105. In an intermediate state, the component tabs 210 are positioned between the latches 705 and not fully inserted into the contact region 530 (FIG. 5A) of a terminal 500 (FIG. 5A). When the tabs 210 are in this position, one or more of the latches is forced into the channel(s) 710 disposed behind the latches 705. This prevents the insertion of the lock member 600, which prevents placing the connector assembly in the locked state.

As shown in FIG. 7B, in the locked state the component tabs 210 are fully inserted into the contact region 530 (FIG. 5A) of the terminal 500 (FIG. 5A) and the fingers 605 (FIG. 6) of the lock member 600 are slidably inserted into the channels 710 behind the latches 705. This prevents movement of the latches 705 into the channels 710. The component is, therefore, prevented from being pulled out of the connector assembly, because the thickness of the tabs 210 is greater than the distance between the latches. For example, in the locked state an operator may not be able to pull the component out of the connector assembly when the connector is in the locked state.

In the locked state, the second pair of retention bumps 620 (FIG. 6) on the lock member 600 may rest on the second pair of retention surfaces 720 on the connector, as shown. This may secure the lock member 600 into the locked state.

Whether the component is in an open or locked state may be determined by visual inspection of the inspection pin 615 of the lock member 600. For example, an operator may be able to tell whether the connector is open or locked by determining how far the inspection pin 615 is inserted relative to the opening on a circuit board through which the inspection pin 615 passes. To enable determining this, the inspection pin 615 may include a mark or an indentation 615*a* that may be utilized as a reference point. For example, in the open state, the mark or indentation 615*a* may be fully visible, as shown in FIG. 7A. In the locked state, the mark or indentation 615*a* may only be partially visible or not visible at all, as shown in FIG. 7B One advantage of this approach is that it enables an operator or machine to verify that the component is fully inserted into the terminals of the connector. This in turn insures good contact between the component and the terminals. This can be important, especially where the amount of current flowing from the component to the terminal is relatively high. Under these conditions the power dissipation in the contact point may be too high and may damage the connector.

Figure 8:
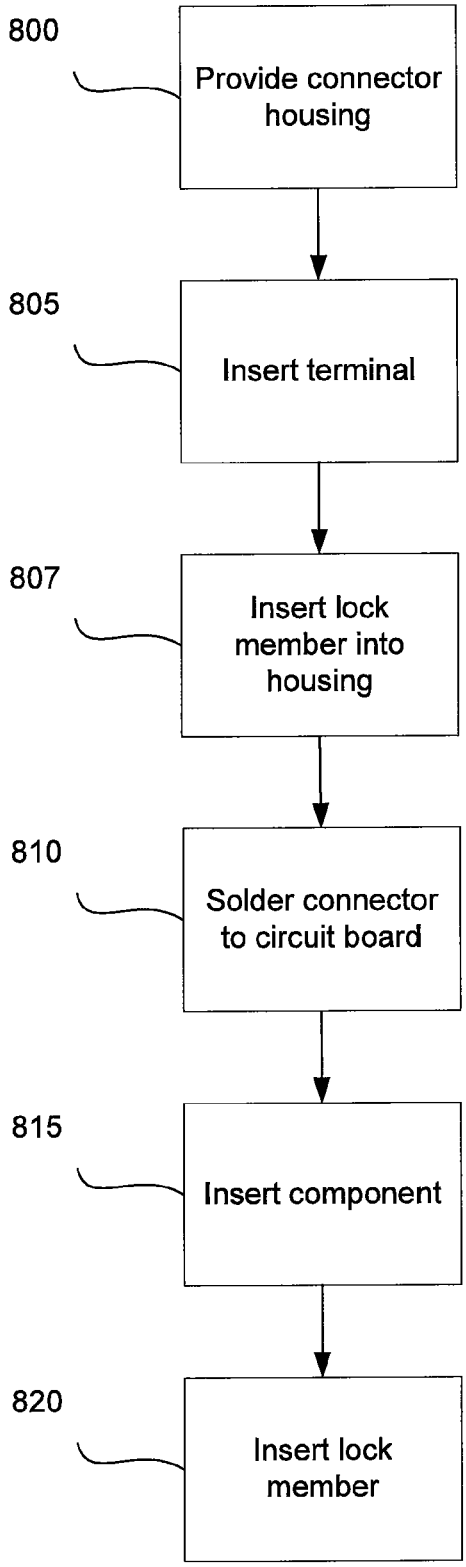
FIG. 8 is a flow diagram that illustrates operations of a connector assembly

FIG. 8 is a flow diagram that illustrates operations of a connector, such as the connector assembly 100 of FIG. 1. At block 800, a housing may be provided. The housing may correspond to the housing 105 described in FIG. 1A.

At block 805, one or more terminals may be inserted into the housing. Each terminal may correspond to the terminal 500 of FIG. 5.

At block 807, a lock member may be inserted into the housing. The lock member may correspond to the lock member 600 of FIG. 6.

At block 810, the connector assembly may be secured to a circuit board after the terminals are inserted into the housing. For example, the connector assembly may be soldered via a reflow process to a circuit board.

At block 815, a component may be inserted into the connector housing. For example, the component described in FIG. 2, may be inserted in the connector housing.

At block 820, a lock member of the connector assembly may be inserted to place the connector assembly into the locked state. The lock member may correspond to the lock member 600 of FIG. 6.

As shown, the connector assembly described above addresses the problems associated with a component that exhibits a high degree of variability in the spacing between plates. For example, the connector assembly may be utilized to provide a secure connection to a fuel cell that includes a stack of plates. The terminals of the connector assembly may be adapted to allow for lateral movement between slots into which the plates are inserted. The widths of the slots may be larger towards ends of the connector assembly housing and smaller towards the center of the housing to evenly distribute any tolerance build-up between the respective distances of the plates. A lock member may be provided to ensure that the component is properly inserted into the connector housing.

While the connector assembly and method for using the connector assembly have been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that connector and method for using the connector are not to be limited to the particular embodiments disclosed, but to any embodiments that fall within the scope of the claims.

We claim:

1. A connector terminal comprising:

a main body Including a plurality of straps, each of the plurality of straps defining a first section, a curved section with a first end connected to a first end of the first section, and a second section connected to a second end of the curved section;

a retention portion connected to respective second ends of the first sections that are opposite respective first ends of the first sections of the connector terminal and configured to secure the terminal into a housing; and a solder tail connected to the retention portion, wherein the respective first sections and curved sections of each of the plurality of straps are separated by a first distance, each of the plurality of straps angles in towards one another in the respective second sections to a distance that is less than the first distance to define a contact region of the connector terminal, and each of the plurality of straps are joined at respective ends of the second sections that are opposite the respective second ends of the curved sections of the connector terminal;

wherein the distance between each of the plurality of straps at the contact region remains substantially unchanged when the contact region of the connector terminal is moved laterally within a plane defined by the plurality of straps in the second section of the connector terminal.

2. The connector terminal according to claim 1, further comprising grooves on the retention portion for securing the connector terminal to a housing.

3. The connector terminal according to claim 1, wherein at the contact region, a distance between the plurality of straps decreases to a distance that is less than a thickness of a contact tab on a component.

4. The connector terminal according to claim 3, wherein the component is a fuel cell.

5. A connector assembly comprising:

a plurality of terminals, each terminal including a main body including a plurality of straps, the plurality of straps defining a first section, a curved section, and a second section;

a retention portion connected to an end of the first section of the terminal and configured to secure the terminal into a housing; and a solder tail connected to the retention portion, wherein straps of the plurality of straps are separated by a first distance in the first section and the curved section of the terminal, the straps of the plurality of straps angle in towards one another in the second section of the terminal to a distance that is less than the first distance to define a contact region of the terminal, and the straps of the plurality of straps are joined at an end' of the second section of the terminal;

a housing defining a plurality of slots in a top side of the housing, each slot of the plurality of slots defining first and second interior surfaces separated by a distance, each first and second interior surface defining a channel configured to receive a terminal of the plurality of terminals, wherein the contact region of each terminal of the plurality of terminals is substantially centered between the first and second Interior surfaces of a respective slot of the plurality of slots, and the distance between the plurality of straps at the contact region stays substantially the same when the contact region is moved laterally between the first and second surfaces.

6. The connector assembly according to claim 5 wherein the distance between the first and second interior surfaces of each slot of the plurality of slots is sized to compensate for a tolerance build-up that occurs in a component.

7. The connector assembly according to claim 5, further comprising a guide on a top edge of each of the first and second surfaces adapted to protect the first and curved sections of the terminal from damage when a component is inserted into the slot.

8. The connector assembly according to claim 5, further comprising retention bumps for preventing deformation of the curved section of the terminal extending from the surface of each channel.

9. The connector assembly according to claim 8, further comprising a ramp on the retention bump that enables the curved section of the terminal to slide passed the retention bump.

10. The connector assembly according to claim 5, further comprising a retention surface on an interior surface of the opening that prevents the terminal from being removed after being inserted.

11. The connector assembly according to claim 5, further comprising at least one alignment pin extending from a bottom surface of the connector housing.

12. The connector assembly according to claim 5, further comprising a crush rib on the at least one alignment pin that enables biasing a position of the connector housing.

13. The connector housing according to claim 5, wherein the component corresponds to a fuel cell plate.

14. A connector assembly comprising:

a housing that includes:

a slot defined in a top side of the housing; and an opening defined in a bottom surface of the housing;

a terminal positioned within the slot; and a lock member adapted to be inserted into the opening of the housing, wherein when the lock member is in an open state, a component is insertable into the slot of the housing and when the lock member is in a locked state an inserted component cannot be removed from the slot of the housing under normal usage, and wherein when the component is partially inserted into the slot, the lock member is prevented from entering the locked state.

15. The connector assembly according to claim 14, further comprising first and second inner fingers extending from the lock member adapted to be slidably inserted into first and second complementary channels disposed behind first and second latches of the housing.

16. The connector assembly according to claim 15, wherein the first and second inner fingers are prevented from being slidably inserted into the first and second complementary channels when a component is partially inserted into the connector.

17. The connector assembly according to claim 15, wherein in the locked state a distance between the first and second latches is greater than a thickness of an upper region of the component and less than a thickness of a tab on a lower region of the component.

18. The connector assembly according to claim 14, further comprising a retention bump on an outer finger of the lock member adapted to engage a complementary retention surface disposed within the opening of the housing so as to prevent the lock member from falling out of the opening of the housing.

19. The connector assembly according to claim 14, further comprising a retention bump on an outer finger of the lock member adapted to engage a complementary retention surface disposed within the opening of the housing so as to secure the lock member into the locked state.

20. The connector assembly according to claim 14, further comprising an inspection pin extending from a bottom surface of the lock member, the inspection pin adapted to extend through an opening in a circuit board so that a region of the inspection pin is visible on an opposite side of the circuit board, wherein a state of the lock member may be determined by visual inspection of the inspection pin.

* * * * *